US009896294B2

(12) United States Patent
Ing et al.

(10) Patent No.: US 9,896,294 B2
(45) Date of Patent: Feb. 20, 2018

(54) APPARATUS FOR PROCESSING A MOVING WEB OF MATERIAL

(71) Applicant: British American Tobacco (Investments) Limited, London (GB)

(72) Inventors: David Ing, Wellington (GB); Martin Daw, Wellington (GB); Glynn Sims, Wellington (GB); Philip Hyde, Wellington (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 74 days.

(21) Appl. No.: 14/652,033

(22) PCT Filed: Nov. 18, 2013

(86) PCT No.: PCT/GB2013/053040
§ 371 (c)(1),
(2) Date: Jun. 12, 2015

(87) PCT Pub. No.: WO2014/091192
PCT Pub. Date: Jun. 19, 2014

(65) Prior Publication Data

US 2015/0329306 A1 Nov. 19, 2015

(30) Foreign Application Priority Data

Dec. 13, 2012 (GB) ..... 1222438.2

(51) Int. Cl.
*B23D 25/12* (2006.01)
*B26D 5/20* (2006.01)
(Continued)

(52) U.S. Cl.
CPC ..... *B65H 29/243* (2013.01); *A24C 5/473* (2013.01); *B65H 27/00* (2013.01); *B65H 35/02* (2013.01);
(Continued)

(58) Field of Classification Search
CPC ..... B26F 1/20; B26D 5/005; B26D 7/265; B26D 7/20; Y10T 83/4838; A24C 5/473;
(Continued)

(56) References Cited

U.S. PATENT DOCUMENTS 2,402,074 A 6/1946 Nield
2,747,417 A * 5/1956 Brown ..... F16H 53/08 112/466
(Continued)

FOREIGN PATENT DOCUMENTS

EP 0154068 3/1984
EP 0882412 3/1998
(Continued)

OTHER PUBLICATIONS

European Patent Office—International Searching Authority; Notification of Transmittal of the International Search Report and the Written Opinion of the International Searching Authority; dated Apr. 11, 2014; Netherlands dated Apr. 11, 2014.

*Primary Examiner* — Ghassem Alie
*Assistant Examiner* — Bharat C Patel
(74) *Attorney, Agent, or Firm* — Cantor Colburn LLP

(57) ABSTRACT

A drum assembly for processing a moving web of material is disclosed. The drum assembly has an outer drum with an axis of rotation and a plurality of support members on which cut patches of the moving web of material are supported as the drum rotates together with said support members about said axis. A cam is disposed within the outer drum and the support members and the cam cooperate with each other as
(Continued)

the outer drum rotates relative to the cam to move the support members in an axial direction to alter the spacing between cut web patches on said support members.

13 Claims, 12 Drawing Sheets

(51) Int. Cl.

| | |
|---|---|
| ***B26D 1/12*** | (2006.01) |
| ***B65H 29/24*** | (2006.01) |
| ***A24C 5/47*** | (2006.01) |
| ***B65H 27/00*** | (2006.01) |
| ***B65H 35/02*** | (2006.01) |
| ***B65H 35/08*** | (2006.01) |

(52) U.S. Cl.
CPC ..... *B65H 35/08* (2013.01); *B65H 2301/351* (2013.01); *B65H 2403/511* (2013.01); *B65H 2406/34525* (2013.01); *B65H 2406/3612* (2013.01); *B65H 2801/54* (2013.01)

(58) Field of Classification Search
CPC ..... B65H 2301/351; B65H 2403/511; B65H 2406/34525; B65H 2406/3612; B65H 27/00; B65H 2801/54; B65H 29/243; B65H 35/02; B65H 35/08; B65H 29/60; B65H 35/04
USPC ..... 156/566–568, 571, 494, 510–515; 83/343–347, 351, 492, 508, 887, 508.1, 83/678, 659, 614, 591, 660, 872, 304, 83/672, 692, 862; 493/39–45; 53/444
See application file for complete search history.

(56) References Cited

U.S. PATENT DOCUMENTS 3,340,757 A 9/1967 Rudszinat
3,834,285 A * 9/1974 Schubert ..... A24D 3/0287 131/94
4,069,724 A * 1/1978 Sobotta ..... F16H 25/16 74/54
4,112,651 A * 9/1978 Bardenhagen ..... B65B 19/20 53/170
4,131,052 A * 12/1978 Skahill ..... F41A 7/10 89/11
4,292,032 A * 9/1981 Luke ..... A24D 3/0258 425/105
4,297,157 A 10/1981 Van Vliet
4,421,283 A * 12/1983 Rippin ..... B65H 75/242 242/529
4,574,022 A * 3/1986 Johnson ..... A61F 13/15593 156/121
4,577,644 A * 3/1986 Grieben ..... A24C 5/336 131/282
4,593,589 A * 6/1986 Gherardi ..... A24C 5/473 83/168
5,074,547 A * 12/1991 Smith ..... B65H 5/226 271/196
5,200,020 A 4/1993 Collins et al.
5,232,100 A * 8/1993 Lewis ..... B07C 5/065 209/537
5,361,783 A 11/1994 Herburg
5,365,815 A * 11/1994 Pfaff, Jr. ..... B26D 7/1818 83/128
5,447,486 A * 9/1995 Anderson ..... B26D 5/20 493/11
5,680,751 A * 10/1997 Premi ..... B65H 69/061 242/475.4
6,149,755 A * 11/2000 McNichols ..... A61F 13/15764 156/264
6,199,360 B1 * 3/2001 Premi ..... B65H 69/061 242/475.4
6,229,115 B1 5/2001 Voss et al.
6,328,832 B1 * 12/2001 Otruba ..... B65C 9/1807 156/215
7,281,621 B2 * 10/2007 Jahnke ..... A24D 3/0287 131/282
7,320,206 B2 * 1/2008 Honegger ..... B29C 65/18 53/373.5
7,435,208 B2 * 10/2008 Garthaffner ..... A24D 3/0258 493/39
7,770,712 B2 * 8/2010 McCabe ..... A61F 13/15764 198/463.1
7,975,584 B2 * 7/2011 McCabe ..... A61F 13/15723 53/462
8,561,987 B2 * 10/2013 Berlingen ..... B41F 22/00 271/276
8,679,282 B2 * 3/2014 Piantoni ..... A61F 13/15756 156/250
8,720,666 B2 * 5/2014 Papsdorf ..... A61F 13/15764 198/377.01
9,227,794 B2 * 1/2016 Papsdorf ..... A61F 13/15764
2003/0145866 A1 8/2003 Hartmann
2005/0172977 A1 8/2005 Jadot et al.
2006/0027065 A1 * 2/2006 Spatafora ..... B26D 1/385 83/13
2010/0258240 A1 * 10/2010 McCabe ..... A61F 13/15756 156/226
2011/0100144 A1 * 5/2011 Neelakantan ..... F16H 63/18 74/473.36
2014/0076118 A1 * 3/2014 Pasaban ..... B26D 1/425 83/591

FOREIGN PATENT DOCUMENTS

GB 477908 7/1936
GB 623969 6/1947
GB 741416 3/1953
GB 2206072 12/1987
GB 2200863 2/1988
GB 2220878 6/1989
WO 2004014161 8/2003
WO WO 2010018449 A2 * 2/2010 ..... B26D 5/20

* cited by examiner

APPARATUS FOR PROCESSING A MOVING WEB OF MATERIAL

FIELD OF THE INVENTION

This invention relates to apparatus and a method for processing a moving web of material, particularly but not exclusively to cutting and spreading a moving web of material prior to a wrapping operation, during manufacture of smoking articles.

BACKGROUND TO THE INVENTION

Smoking articles are generally formed of a tobacco rod and a filter wrapped in a material, such as paper. A band of paper may be used to join together a wrapped tobacco rod and a wrapped filter. Cigarettes with different construction and configuration are possible but do generally comprise rod shaped components, such as tobacco rods and filters that are wrapped in materials in various arrangements.

Machinery for preparing and wrapping a moving web of material around a tobacco rod, a filter or an assembly of a tobacco rod and a filter may include a web handling system that handles thin strips of material, arranges and aligns the strips of material with the relevant components and feeds the strips into a wrapping process to wrap the strips of material around the components of the smoking article.

Some smoking articles require a plurality of paper portions to be wrapped around a smoking article in a spaced arrangement, with gaps between each portion.

SUMMARY OF THE INVENTION

In accordance with embodiments of the invention, there is provided a drum assembly for processing a moving web of material comprising an outer drum having an axis of rotation, a plurality of support members on which cut patches of the moving web of material are supported as the drum rotates together with said support members about said axis, and a cam disposed within the outer drum, wherein the support members and the cam cooperate with each other as the outer drum rotates relative to the cam to move the support members in an axial direction to alter the spacing between cut web patches on said support members.

The cam may comprise a cylindrical element mounted coaxially within the outer drum and may have cam tracks extending circumferentially around its surface, the support members may be mounted to the outer drum for movement in an axial direction and each may have a cam follower slideably received in a cam track in the cylindrical element.

The cam tracks may be continuous and define closed and open positions of the support members separated by transition regions during which the support members move gradually from one position to the other as the outer drum rotates.

The transition regions of adjacent cam tracks may be staggered so that the support members toward the outer ends of the outer drum begin to move in an axial direction prior to movement of the remaining support members.

The transition region of adjacent cam tracks may be configured such that axial movement of all the support members ends substantially simultaneously.

Each of the plurality of support members may comprise an outer face which supports the web, said outer faces may have apertures for connection to a source of negative pressure to hold the material on the outer drum.

The drum assembly may comprise flexible or extendable pipes extending laterally within the outer drum between the support members and a manifold that rotates with the drum and is connectable to source of negative pressure.

In accordance with embodiments of the invention, there is provided apparatus for processing a moving web of material including a drum assembly, as described above, and lateral and longitudinal cutting assemblies to cut the moving web of material into a series of web patches on the outer drum.

The lateral cutting assembly may comprise a lateral cutting drum having at least one radially extending blade, said lateral cutting drum may be located adjacent to the outer drum such that as each drum rotates the radially extending blade cuts the moving web of material on the outer drum.

The lateral cutting drum and the outer drum may be configured such that the radially extending blade cuts the moving web of material against, or on, a laterally extending edge of a support member.

The rotational speed of the outer drum and the lateral cutting drum may be configured such that the outer surface of the outer drum is travelling faster than the linear speed of the moving web of material, such that as the radially extending blade laterally cuts a portion from the moving web, a space is created between the trailing edge of the cut portion and the leading edge of the moving web of material.

The longitudinal cutting assembly may comprise a plurality of rotating blades arranged adjacent to each other, each blade acting against an edge of a support member to cut the moving web of material on the outer drum.

The apparatus may further comprise an adhesive application assembly that applies adhesive to the moving web of material prior to receipt of the moving web of material on the outer drum.

The adhesive application assembly may be configured to apply adhesive to selected regions of one side of the moving web of material, said regions to which adhesive is not applied corresponding to the lines along which the lateral and longitudinal cutting assemblies will cut the moving web.

In accordance with embodiments of the invention, there is provided a method of processing a moving web of material comprising supporting cut patches of said web on support members of an outer drum of a drum assembly as it rotates about its axis of rotation, the support members cooperating with a cam disposed within the outer drum so that the support members move in an axial direction as the outer drum rotates to alter the spacing between cut web patches on said support members.

The method may include the step of cutting the moving web of material laterally and longitudinally prior to cooperation between the support members and the cam to alter the spacing between the cut web patches.

The method may further include controlling the rotational speed of the rotating outer drum and the linear speed of the moving web of material such that cut web portions are longitudinally spaced as the web is laterally cut.

The method may further include providing a negative pressure to apertures in the plurality of support members to retain the web portions on the rotating outer drum during rotation of said drum.

BRIEF DESCRIPTION OF THE DRAWINGS

Embodiments of the invention will now be described, by way of example only, with reference to the accompanying drawings, in which.

DETAILED DESCRIPTION OF THE DRAWINGS

An example of a product with spaced portions of wrapping material formed during manufacture of smoking articles is disclosed in the applicant's co-pending application GB1113936.7, the entirety of which is hereby expressly incorporated by reference. The smoking articles disclosed in this document comprise filters with spaced portions of paper wrapped around the outside to form part of the adjustable ventilation mechanism. During manufacture of these smoking articles, filter rods are provided with spaced portions of wrapping material that are wrapped around the filter one or more times.

Figure 1A:
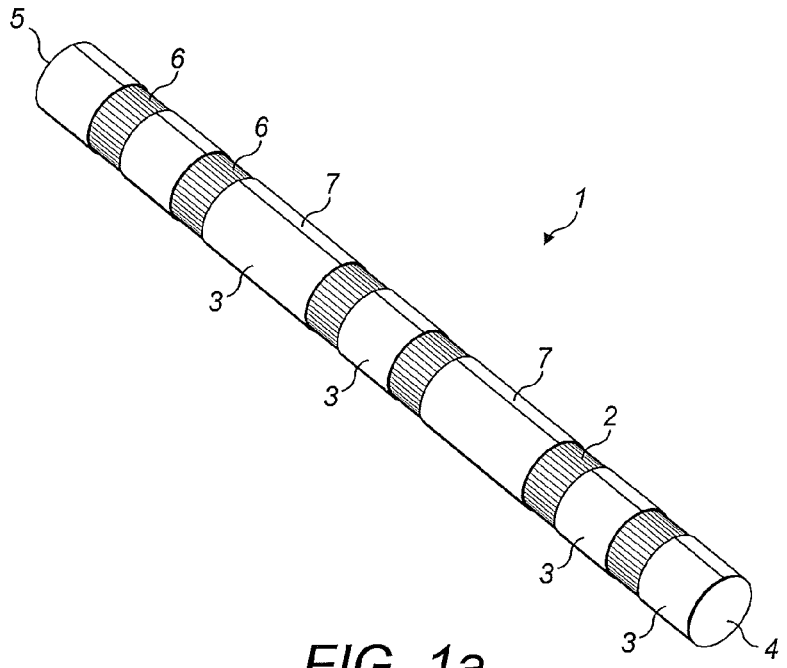
FIGS. 1*a* and 1*b* show a filter rod with spaced portions of material wrapped around the filter rod, as produced in the production of smoking articles.
Figure 1B:
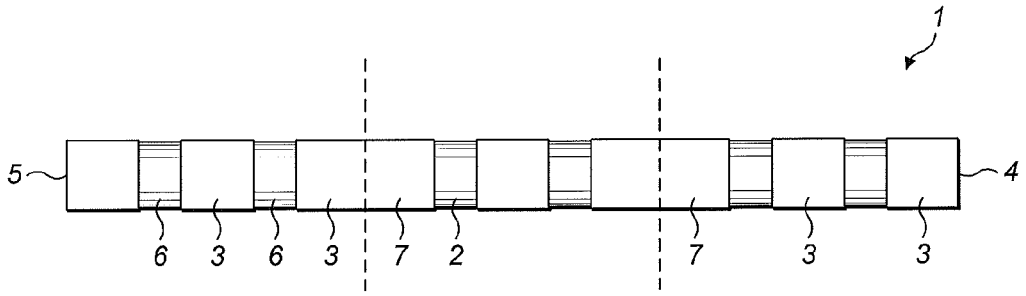

The partially wrapped filter rod 1 shown in FIGS. 1*a* and 1*b* is produced during the manufacture of the smoking articles described in the applicant's co-pending patent application GB 1113936.7. The partially wrapped filter rod 1 comprises a filter portion 2, made from acetate or a similar material, and a plurality of spaced portions 3 of material wrapped around the rod 2, in this case paper such as tipping paper commonly used in the manufacture of smoking articles. The smoking articles disclosed in GB 1113936.7 have filters with adjustable ventilation that rely on spaced tipping paper portions to allow two portions of the filter to rotate relative to each other too alter the ventilation. The tipping paper portions may be wrapped once or twice around the filter rod in spaced relation and after wrapping the filter portion may be cut into two, three or more individual filters and then integrated with a smoking article.

FIGS. 1*a* and 1*b* show the partially wrapped filter rod 1 with a plurality of portions of tipping paper 3 wrapped around the filter rod 2 in a spaced arrangement. The tipping paper portions 3 may also have different widths. The configuration of the position, size and quantity of the tipping paper portions 3 depends on the requirements of the smoking article and the manufacturing process and therefore may vary. In this example, the rod has seven portions of tipping paper, one located at each end 4,5 of the filter rod 2, creating six gaps 6 between the tipping paper portions 3. Two of the wrap portions 7 are double the width of the others and at a later stage in the smoking article production process the wrapped filter rod 1 is cut into several smaller filter portions along the middle of these wider wrap portions 7. The wrapped filter rod 1 shown in FIGS. 1*a* and 1*b* may be cut into three equal size parts to create filters for smoking articles.

It will be appreciated that the size and arrangement of the filter rod 2 and the paper wrapped portions 3 shown is only an example and different configurations can be produced for different applications. The apparatus and method described hereinafter is for production of the particular example of the wrapped filter rod 1 shown in FIGS. 1*a* and 1*b*. However, it will be appreciated that the invention as defined in the claims is capable of processing a moving web of material in different configurations by simple modification of the processes described herein.

A typical rod wrapping process may include a rotating drum that carries filter rods onto which patches of paper are applied. As the drum rotates, the rod is also caused to rotate about its own axis on the surface of the rotating drum, causing the paper patches to wrap around the filter rods. This type of wrapping process can be used to create the partially wrapped filter rod described with reference to FIGS. 1*a* and 1*b* if the tipping paper is fed into the wrapping process as a series of parallel and axially spaced patches of material. The manufacturing system described hereinafter is suitable for producing these parallel and axially spaced patches from a moving web of material and presenting them to a wrapping apparatus.

Figure 2:
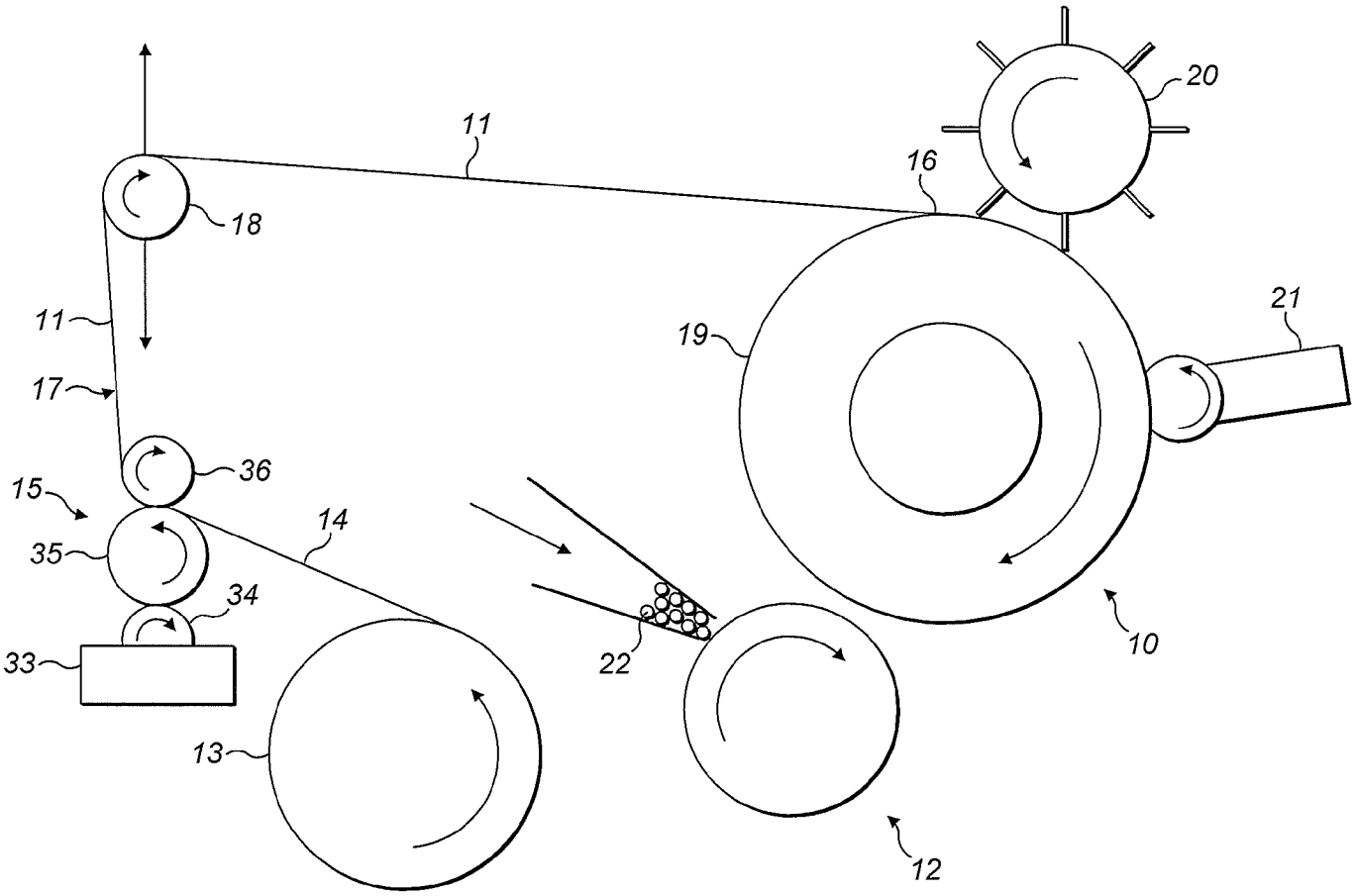
FIG. 2 shows a schematic diagram of manufacturing apparatus for producing the wrapped filter rob of FIGS. 1*a* and 1*b;*

FIG. 2 shows a schematic diagram of apparatus of a manufacturing system for producing filter units wrapped with spaced tipping paper portions, such as those described with reference to FIGS. 1*a* and 1*b*. The apparatus includes a cutting and spreading drum assembly 10 configured to cut a moving web of material 11 into patches, spread those patches into a desired arrangement and present those patches to wrapping apparatus 12 which combines the patches with filters rods 22.

A bobbin 13 supplies material to the process as a continuous web 14 with fixed width which travels through the system on rollers and drums and through an adhesive application assembly 15 to the feed point 16 of the cutting and spreading drum assembly 10.

After leaving the bobbin 13 the web 14 enters an adhesive application means 15 which applies adhesive to the moving web 14. The adhesive is for securing the material patches in the wrapped position around the filter rod later on in the process.

After receiving adhesive in selected regions on one side 17, the web 11 travels over a control roller 18, the position of which is moveable or adjustable to control the tension in the web 11 and/or the quantity of adhesive being applied and/or the position and orientation of the web 11 relative to the cutting and spreading drum assembly 10. The control roller 18 may act against a spring mechanism, or the position may be controlled by a pneumatic or electric actuator, and/or it may manually moveable, for example during machine set-up.

The web 11 with adhesive applied to one side is then fed onto the cutting and spreading drum assembly 10 which is configured to process the web 11 to produce a plurality of parallel spaced patches and present them to the wrapping apparatus 12 for forming filters with spaced tipping paper portions, such as those shown in FIGS. 1*a* and 1*b*. The web 11 is fed onto the cutting and spreading drum assembly 10 with the side 17 to which adhesive has been applied facing outwards, away from the drum assembly 10, with the non-adhered side of the web 11 contacting the outer face 19 of the cutting and spreading drum assembly 10.

Adjacent to the cutting and spreading drum are a lateral cutter 20 and a longitudinal cutter 21 that cut the moving web 11 as it is carried on the outer face of the drum assembly 10. The drum assembly is configured to support the web 11 as it is cut and then to spread the cut web patches into the desired arrangement.

The drums, rollers and any drive points, such as nip drives (not shown) of the system that pull the web of material 11, 14 through the different processes are actuated by a drive system which may comprise one or more electric motors, such as servo or stepper motors, individually driving each component with a central control system configured to control the speed and sequential alignment of each drum. Alternatively, a central drive motor may be used and toothed belts and/or gears and/or chain drives can be used to drive each drum from the central drive system, thereby maintaining sequential rotational alignment. It will be appreciated that not all components need to be driven. Some components may have idle rollers that turn freely as the web moves over them, or be provided with smooth surfaces that the web moves over without rotation.

It will be appreciated that FIG. 2 only shows the basic components of the system and other components may be included, such as nip drive rollers to grip and drive the moving web through the system, tension control systems, buffers and/or a splice system to change (manually or automatically) to a second bobbin of material when the first bobbin is depleted.

Figure 3:
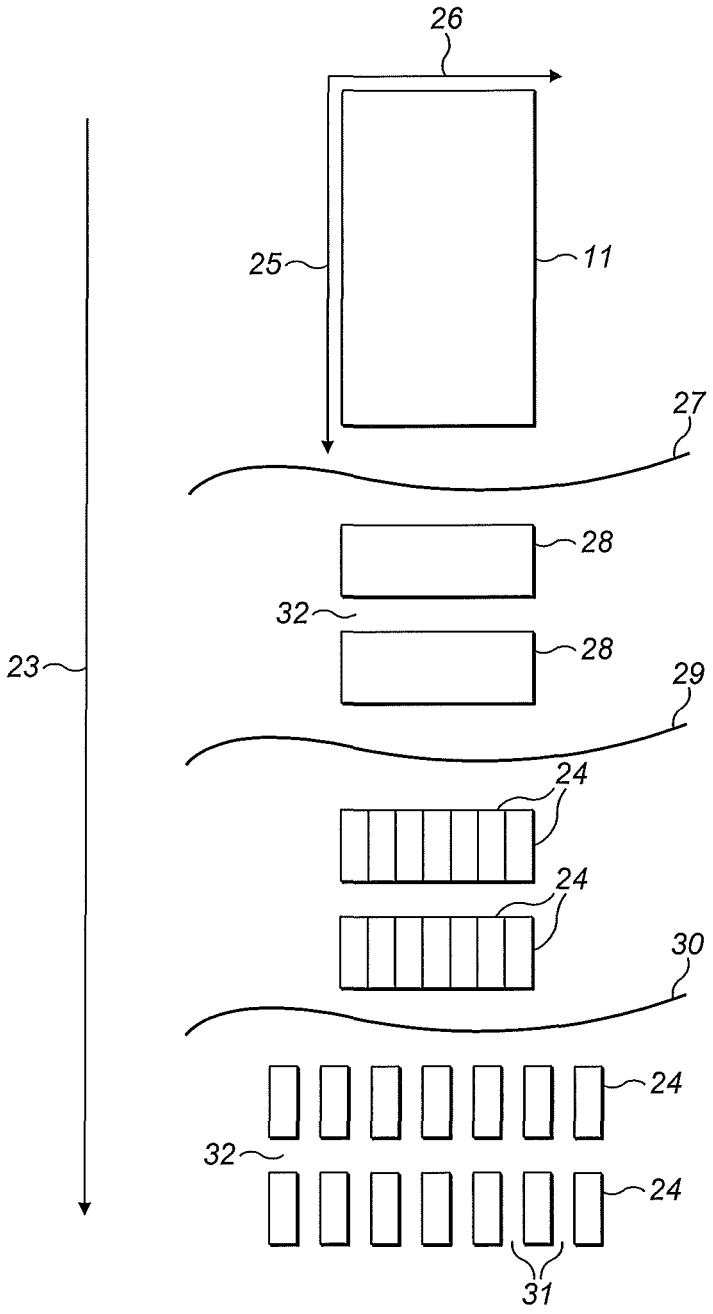
FIG. 3 shows a schematic representation of the some of the processes performed by the apparatus of FIG. 2.

A schematic operational diagram of the cutting and spreading drum assembly 10 and cutters 20, 21 is shown in FIG. 3, the processes being arranged sequentially moving downwards, with arrow 23 representing the sequence as the cutting and spreading drum assembly 10 rotates from the point 16 (see FIG. 2) where the web 11 is received on the cutting and spreading drum assembly 10 to the point where the processed and arranged patches 24 are presented or transferred to the subsequent wrapping apparatus 12 (see FIG. 2).

Arrow 25 shows the direction that will be referred to as the axial or longitudinal Direction—along the web of material 11 in the lengthwise direction. Arrow 26 shows the transverse or lateral direction—across the web of material 11.

FIG. 3 firstly shows the continuous web of moving material 11 which is fed onto the drum assembly 10. The web 11 is then laterally cut 27, in a transverse direction 26 across the web 11, such that the web 11 is cut into a series of transverse portions 28 which are spaced from each other to create an axial spacing 32. The transverse web portions 28 are then cut or slit 29 in the longitudinal direction 25 such that each transverse portion 28 is cut into a plurality of parallel adjacent patches 24 of the desired size and order for wrapping around the filter and forming the wrapped filter rod described with reference to FIGS. 1*a* and 1*b*. Next, these patches 24 are spread apart 30 to create a spacing 31 between each patch 24 in the transverse direction but maintain the axial spacing 32 and longitudinal spacing such that the patches 24 are arranged in a manner suitable for directly transferring to the wrapping apparatus 12 (see FIG. 2) for wrapping onto a filter rod.

During the process schematically depicted in FIG. 3, none of the web 11 is removed from the system or wasted. Both of the cutting operations 27, 29 separate the material without sacrificing any material—no material is cut away to create the spacing 32, 31 between each portion 28 or patch 24 in the transverse or axial direction, as will be explained.

It will be appreciated that the sequential order described with reference to FIG. 3 may be altered, so long as the final patch 24 arrangement remains relevant for the requirements of the product being wrapped in the patches. For example, the web 11 may be longitudinally cut 29 prior to the transverse cutting 27. Alternatively, the web 11 may be longitudinally cut 29, then spread 30 into a plurality of spaced ribbons (not shown), then transversely cut 27 to create patches. The wrapping apparatus may itself comprise a transverse cutter that cuts spaced parallel ribbons into the patches during the wrapping process. In this case, the cutting and spreading drum may perform the longitudinal cutting and spreading operations to provide spaced parallel ribbons to the wrapping process. The apparatus described herein is for carrying out the example configuration depicted in FIGS. 2 and 3, although it will be appreciated that variations may still fall within the scope of the claims.

Referring again to FIG. 2, as previously explained, the adhesive application means 15 applies adhesive to one side 17 of the web 14 supplied from the bobbin 13. Adhesive is applied to the web 14 in selected areas that correspond to the relevant areas for securing the subsequently cut patches 24 on the filter rod during the wrapping process. Adhesive is not applied to the web 11 in the regions where the web will be cut, to prevent accumulation of adhesive on the cutters. In the example shown schematically in FIG. 2, the adhesive application means 15 comprises an adhesive bath 33, an adhesive pick-up roller 34, an application roller 35 and a pressure roller 36. The pick-up roller 34 brings adhesive from the bath 33 which is transferred to the application roller 35 which in turn applies the adhesive to the web 14. The application roller 35 may comprise raised lands and recesses such that adhesive is applied to selected areas of the web 14 and leaves other areas free of adhesive. The pressure roller 36 provides a force that holds the web 14 against the application roller 35 to ensure adhesive is adequately transferred.

Figure 4:
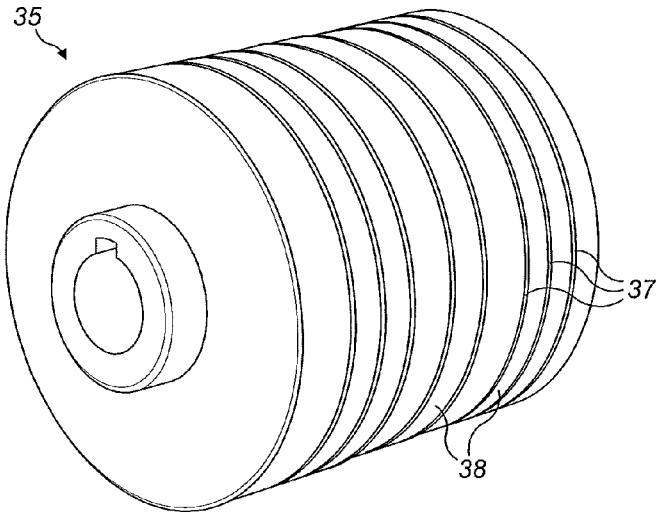
FIG. 4 shows an example of an adhesive application roller that may be used in the apparatus of FIG. 2.

A possible example of the application roller 35 is shown in FIG. 4, with recessed grooves 37 and raised lands 38 to selectively apply adhesive to different regions of the web 14. In this example, adhesive is applied in continuous strips along the web 14, separated by the lines, created by the recesses 37, where no adhesive is applied to the web 14. Adhesive application systems such as this are known in the art and further explanation of the workings of this assembly is omitted.

Figure 5:
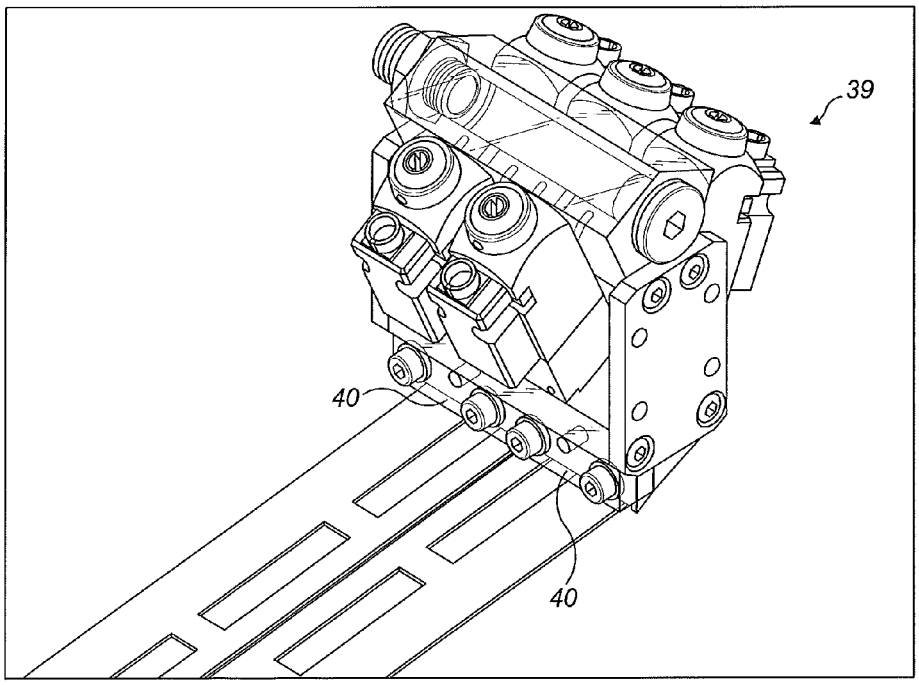
FIG. 5 shows an example of an adhesive applicator that may be used in the apparatus of FIG. 2.

The adhesive application means 15 may instead comprise an injection head or spray gun with multiple application points to apply a plurality of adhesive ribbons to the web 14. An example of this is shown in FIG. 5 with an adhesive dispensing unit 39 with multiple adhesive dispensing heads 40 applying adhesive to the web 14 travelling underneath. The application heads 40 may contact the web 14 or be spaced from the web to provide adhesive from a distance. These systems are also known in the art and further explanation is omitted.

The apparatus of the cutting and spreading drum assembly 10 for carrying out the processes as described with reference to FIG. 3 will now be described.

Figure 6:
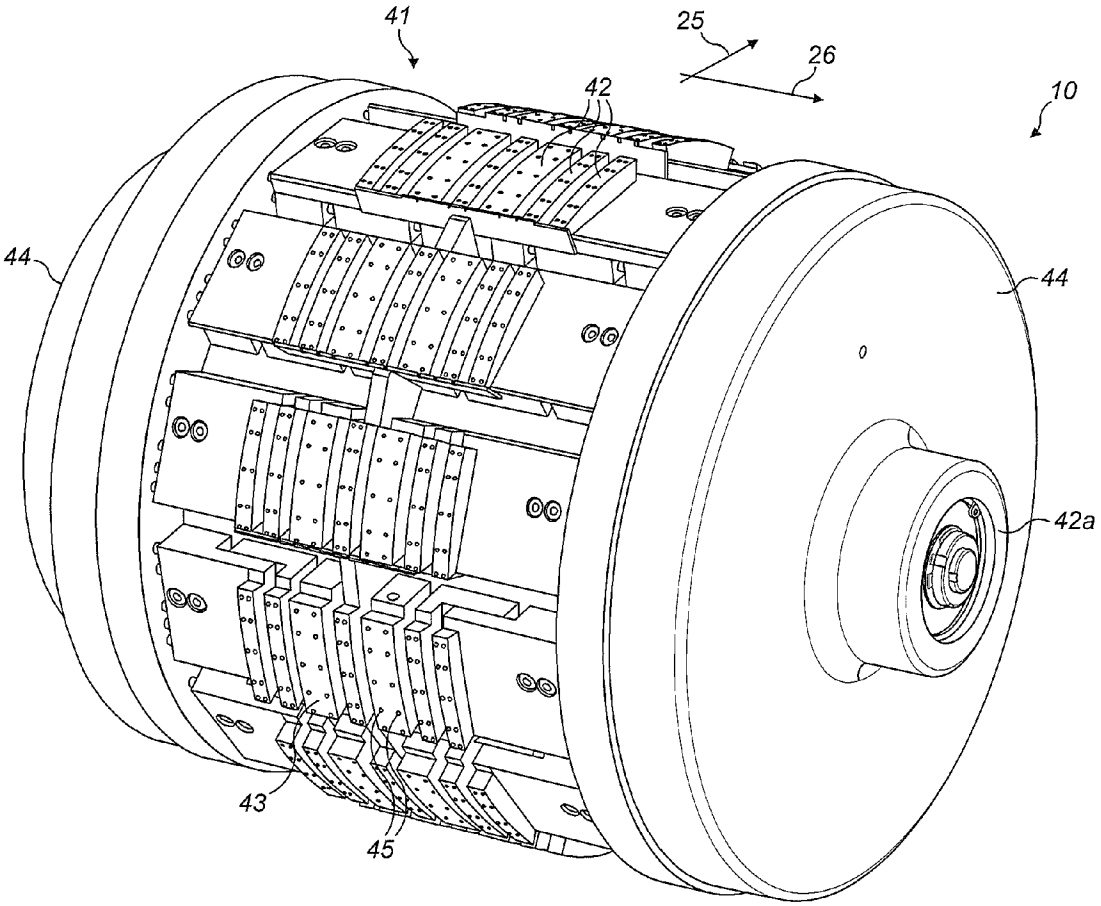
FIG. 6 shows the cutting and spreading drum of the apparatus of FIG. 2.

The cutting and spreading drum assembly 10 is shown in FIG. 6 and comprises a rotating outer drum 41 which is supported on bearings 42*a* located at both ends 44 of the drum assembly 10. The outer drum 41 is rotatably driven by the drive system (not shown). The outer rotating drum 41 also comprises a plurality of moveable support members 42 which form the outer surface on which the web 11 is received. Essentially, the outer circumferential face of the outer drum 41 has a plurality of moveable support members 42 with arcuate outer support faces 43 to contact and receive the web 11. These moveable support members 42 provide positional support to the web 11 as it is cut and spread and also act as a counter-knife, or anvil, for the cutting processes, as will become apparent.

The moveable support members 42 are constrained to move in a transverse direction 26, towards the ends 44 of the drum assembly 10, as the outer drum 41 rotates; the moveable support members 42 are in a closed arrangement at the point 16 (see FIG. 2) at which the web 11 is fed onto the drum assembly 10, with each of the members 42 contacting the next leaving no, or very little, space therebetween. The moveable support members 42 are circumferentially spaced around the outer face of the rotating drum assembly 10 and this spacing defines the axial spacing 32 (see FIG. 3) created by the lateral cutting process (27).

The rotating outer drum 41 has a vacuum system that provides a vacuum holding force on the web 11 via apertures 45 in the outer support surfaces 43 of the moveable support members 42. The vacuum force holds the web 11 against the moveable support members 42 to carry the web 11 and patches around the drum assembly 10 as the outer drum 41 rotates. The first cutting process (in this example, lateral cutting 27 (see FIG. 3)) occurs as the web 11 is fed on to the outer rotating drum 41 with the vacuum force acting to hold the web 11 against the moveable support members 42.

Figure 7:
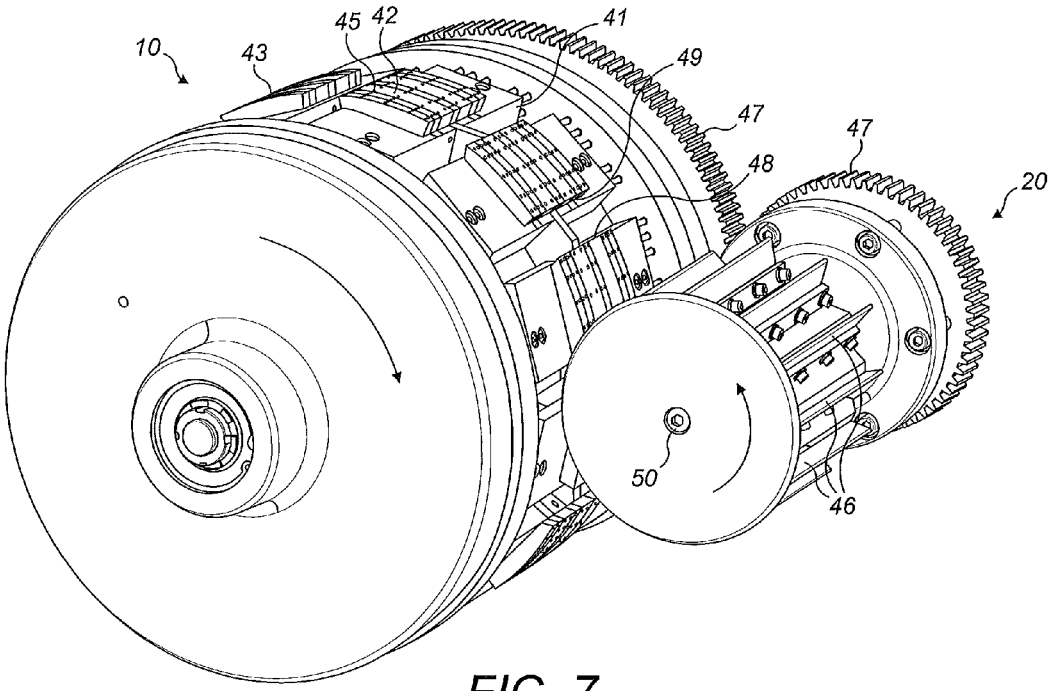
FIG. 7 shows the cutting and spreading drum and the lateral cutting drum of the apparatus of FIG. 2.

FIG. 7 shows the lateral cutting drum 20 positioned adjacent to the outer rotating drum 41. The lateral cutting drum 20 comprises a plurality of cutting blades 46 extending radially from the cutting drum 20 that sequentially contact the outer rotating drum 41 as the two drums 20, 41 rotate in opposite directions. The lateral cutting drum 20 is driven by the gear set 47 acting between the two drums 20, 41, such that the outer rotating drum 41 drives the lateral cutting drum 20 in the opposite direction. This ensures that the speed and timing between the two drums is controlled and maintained. As the two drums rotate, each blade 46 comes into contact with the outer rotating drum 41 and cooperates with a transverse face or edge 48 of a moveable support member 42, which acts as a counter-knife, to shear cut the web 11 into a series of transverse web portions 28, as described with reference to FIG. 3.

To create the axial spacing 32 between the transverse web portions 28 (see FIG. 3) the rotational speed of the outer rotating drum 41 is set such that the linear speed of the outer surface 43 of the support members 42 is greater than the linear speed of the web 11. Therefore, as the web 11 is cut into transverse portions, each newly cut portion is held on the outer drum 41 by the vacuum force from the apertures 45 and moves away from the uncut web 11, creating the axial spacing. In the time between each cut, the speed difference between the web 11 and the outer drum 41 means that the web 11 is moving at a slower speed than the outer surface of the drum 41, creating some relative movement; the support members 42 will move underneath the uncut web 11 until the leading edge 49 of the next support member 42 is aligned with the cut edge of the web 11, at which point in the sequence another cut occurs to create a transverse portion which is retained on the support members and carried away from the web 11. The circumferential spacing between each of the support members 42 determines the axial spacing 32 as well as the required rotational speed of the later cutting drum 20. The lateral cutter 20 separates each transverse web portion when it is aligned with the edges 48, 49 of the support members 42. The leading edge of a transverse web portion 28 (see FIG. 3) is cut against the trailing transverse edge 48 of the support member which is ahead of the support member that will carry that web portion. The trailing edge of each transverse portion is cut against the trailing transverse edge 49 of the support member 42 that will carry that web portion. The radially extending knives 46 of the lateral cutter 20 are circumferentially arranged around the lateral cutter 20 according to the cutting sequence described above.

The lateral cutting drum 20 shown in FIG. 7 comprises a central shaft 50 which provides support for the plurality of radially extending blades 46 that protrude from the shaft 50 and contact the outer rotating drum 41 to cut the web 11. The blades 46 may cut the web 11 by shear action, with each cutting blade 46 overlapping against an edge of the counter-knife edges 48 of the moveable support members 42 as the drums rotate. Alternatively, the blades 46 and moveable support members 42 may be configured to cut the web 11 by means of crush cutting; the blade 46 crushing the web 11 against a flat hard surface, such as the outer circumferential face 43 of the moveable support members 42. It will be appreciated that the cutting blades 46 and counter-knife edges 48 may be arranged to perform other cutting actions.

The length of the transverse web portions 28 (see FIG. 3) created by the transverse cutting process is selected to match the circumference of the filter around which the patches 24 will be wrapped. The length of these portions will be wrapped circumferentially around the filters in a subsequent operation so the length of the lateral cuts will be selected for a single wrap (once around the filter), double wrap (twice around the filter) or any other configuration that is desired for the filter.

Referring back to FIG. 3, following the lateral cutting operation 27, the transverse web portions 28 are cut into patches 24. A longitudinal cutting or slitting operation 29 cuts the transverse portions 28 into the desired number of patches 24 and the moveable support members 42 of the cutting and spreading drum assembly 10 again support the patches and act as a counter-knife to cutting blades, as shown in FIG. 8.

Figure 8:
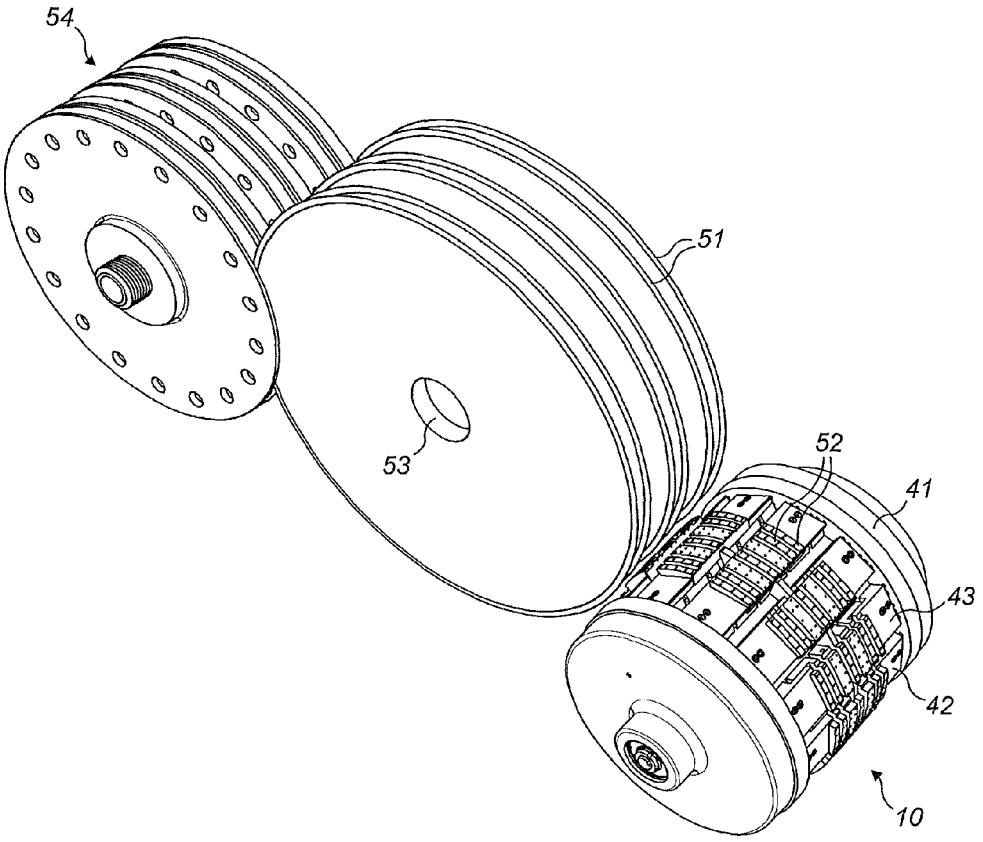
FIG. 8 shows an example of longitudinal cutting blades that may be used in the apparatus of FIG. 2.

FIG. 8 shows the longitudinal cutter 21 (see FIG. 2) with a plurality of longitudinal cutting blades 51 positioned adjacent to the outer rotating drum 41 such that each cutting blade 51 cuts the transverse web portions into patches. Each longitudinal cutting blade acts against or with a longitudinal edge 52, or the outer face 43 of a moveable support member 42, to shear slit or crush cut the transverse web portions longitudinally into parallel adjacent patches, as was described with reference to FIG. 3. The blades 51 are mounted on a rotating shaft 53 and the separation between the longitudinal cutting blades 51 defines the cut width of the patches and should be set according to the product being made. Also shown in FIG. 8 is an arrangement of sharpening blades 54, positioned adjacent to the longitudinal cutting blades 51 to sharpen them as the machine operates, maintaining the cutting effectiveness of the blades 51.

The shaft 53 on which the longitudinal cutting blades 51 are mounted is free to rotate on bearings and is not driven. The shaft 53 and the blades 51 can rotate freely and turn due to the reaction forces from the cutting interaction with the outer rotating drum 41, which is driven, and the web 11.

Figure 9:
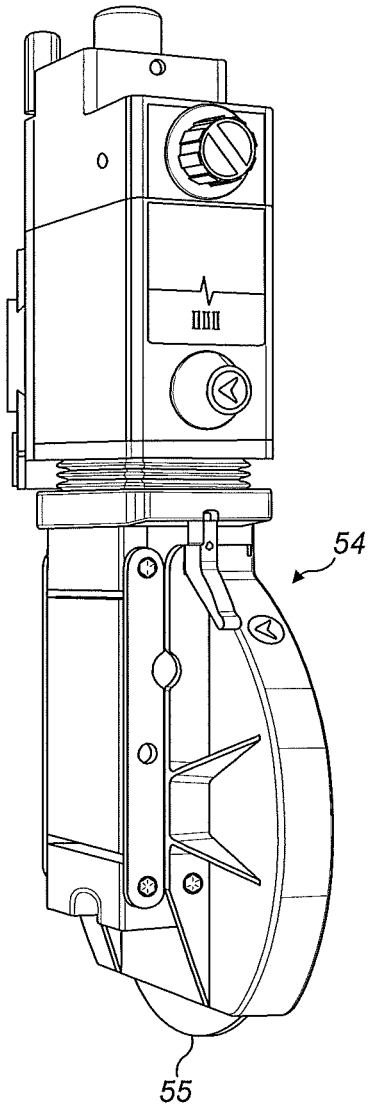
FIG. 9 shows an example of longitudinal cutting blades that may be used in the apparatus of FIG. 2.

Alternatively, the longitudinal cutting operation may be carried out by a plurality of separate slitting knives 54, such as those shown in FIG. 9. Several of these knives 54 can be arranged adjacent to each other and each knife 54 is operable under pneumatic pressure to push the freely rotating disk blade 55 against the edge 52 or face 43 of the moveable support member 42 to create a shear or crush cutting action that cuts the transverse web portions into patches.

As explained previously, adhesive is applied prior to the cutting and spreading operations and is applied to the side 17 of the web 11 facing outwards during the cutting and spreading operations. Selected areas of the web 11 remain adhesive free and these areas are configured to align with the cutting blades so that the blades cut through the web in regions with no adhesive. This prevents adhesive accumulating on the blades and maintains the cutting effectiveness. This selective adhesive application can be defined by the lands 38 and recesses 37 on the gluing roller 35 (see FIG. 4, as shown in FIG. 4, or the electronic control and positioning of the adhesive applicator heads of FIG. 5.

Once the patches have been laterally and longitudinally cut and are held against the outer faces 43 (see FIG. 6) of the support members 42 by the vacuum force, the spreading mechanism begins to move the support elements 42 apart, towards the ends 44 of the drum 41, to create the transverse spacing between the patches.

Figure 10:
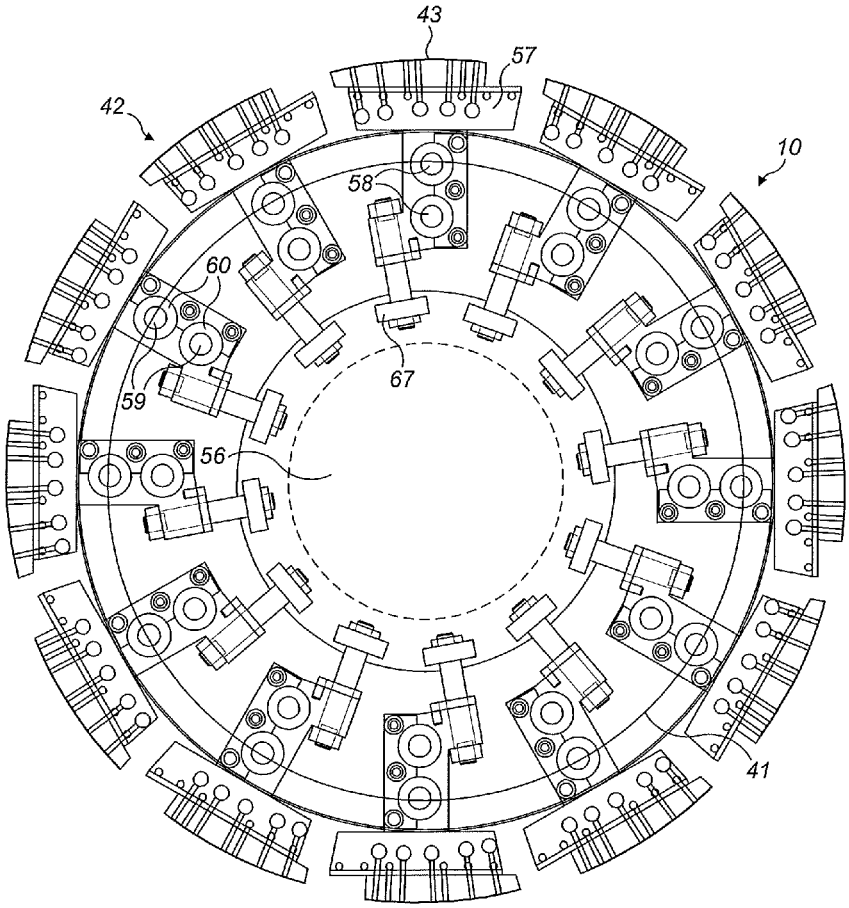
FIG. 10 shows a cross-sectional view of the cutting and spreading drum of the apparatus of FIG. 2.

FIG. 10 shows a detailed cross-section of the cutting and spreading drum assembly 10 with the outer rotating drum 41 and a fixed stationary cam 56 located within the rotating outer drum 41. The moveable support members 42 each comprise an arcuate outer support surface 43 that supports the moving web, transverse patches and cut patches during the cutting and spreading processes. Each moveable support member 42 also comprises a body 57, each with two bores 58 for receiving linear slide rods 59. Linear slide bearings 60 may be mounted in the bores 58 in the moveable support members 42 to slide along the linear slide rods 59 that extend transversely across the outer rotating drum 41. The linear slide rods 59 and linear slide bearings 60 may alternatively be substituted with any type of linear-motion bearing, such as a rail and slider or ball bearing arrangement. Extending radially inwards from each body 57 is a cam follower 67, such as a rotating element on an arm, that interacts with the stationary cam 56 positioned within the outer rotating drum 41. The transverse position of each of the moveable support members 42, along the linear slide rods 59, is defined by cam tracks in the outer surface of the cam 56.

This arrangement constrains movement of the support members 42 to a transverse direction, towards the ends 44 of the drum (see FIG. 6) along the linear slide rods 59, so that the interaction between the cam followers 67 and cam tracks 61 in the stationary cam 56 defines the transverse position of each moveable support member 42 during rotation of the outer drum 41 about the cam 56.

Figure 11:
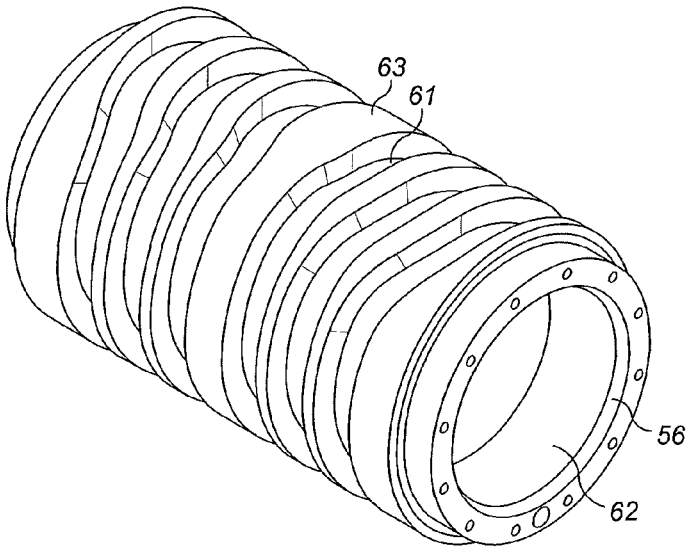
FIG. 11 shows the stationary cam of the cutting and spreading drum of FIG. 10.
Figure 12:
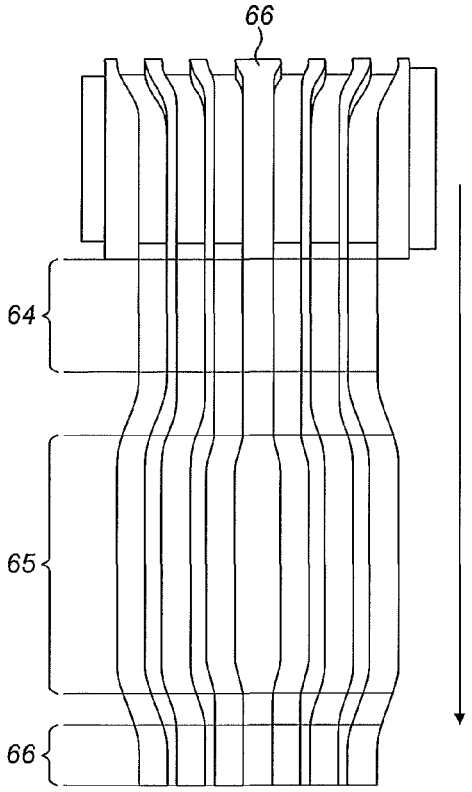
FIG. 12 shows the stationary cam of FIGS. 10 and 11 and also the cam track profile defined by the cam.

The stationary cam 56 is shown in FIG. 11 and has a central bore 62 for mounting on a fixed spigot (not shown) so that the outer rotating drum 41 rotates around the outside of the cam 56. The outer circumferential face 63 of the cam 56 has a series of cam tracks 61 cut into the surface and the profile created by these cam tracks 61 is shown in FIG. 12, which is described in more detail later. The cam tracks 61 themselves should be compatible with the cam followers 67; the width of each cam track 61 may be selected within a tolerance of the size of the cam followers 67 and the cam track 61 may be hardened. The radius of each curve of the cam tracks 61 may also be selected within a tolerance defined by the width of the cam track 61 and size of the cam follower 67.

Figure 14A:
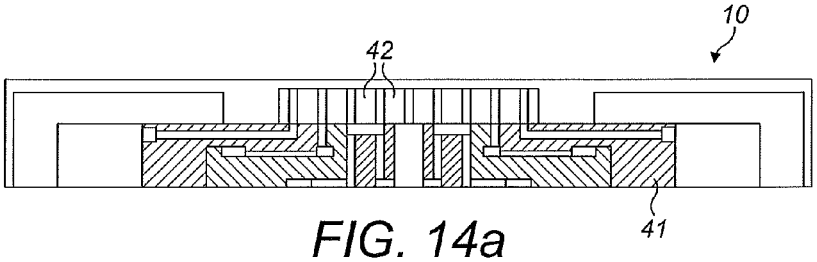
FIGS. 14*a* and 14*b* show cross-sectional views of the cutting and spreading drum showing example open and closed positions of the support members.
Figure 14B:
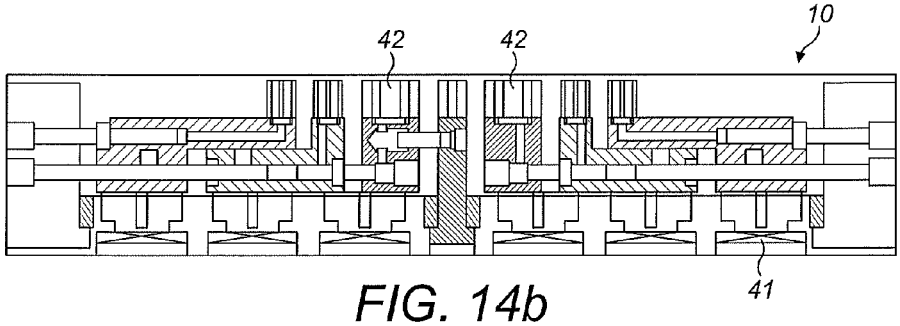

The profile of the cam tracks 61, which define the positions and separation of the moveable support members 42 during rotation of the outer drum 41, is shown in FIG. 12. As can be seen, the cam profile has two positions and as the drum 41 rotates the support members 42 change between these positions and back again. The first position 64 is a 'closed' arrangement, with the cam tracks 61 arranged such that the support members 42 are immediately adjacent to each other. This position is also shown in FIG. 14*a* which shows each of the moveable support members 42 contacting each other. The support members 42 are in this first, closed position when the web 11 is first received on the drum assembly 10 (see FIG. 3) and, in the example described above, through the transverse and longitudinal cutting processes 27, 29. The overall width of the support members 42 in the closed position 64 matches the width of the web 11. The second position 65 is an open, spaced out arrangement which defines the spacing between the patches for wrapping onto the filter rod. The second position 65 is also shown in FIG. 14*b* which shows the spacing between each of the support members 42. As can be seen, in this example, there are an odd number of support members 42 and so the central support member 66 does not move, which will result in a patch being wrapped around the centre of the filter rod, as shown in FIGS. 1*a* and 1*b*.

In this example, each of the patches has the same spacing so the profile of the cam tracks 61 is designed to achieve this. However, it will be appreciated that the cam track profile would be defined by the desired spacing of the patches on the filter rod being produced, which may include uneven spacing. In the example cam track profile shown, the start points for movement from the first position 64 to the second position 65 of each cam track 61 are staggered, with the end points occurring simultaneously. Therefore, as the outer drum 41 rotates and the spreading motion begins, the outermost support members begin to move first, with the innermost support members beginning to move lastly. However, as the outermost support members have to move a greater distance, each of the support members reaches the second position 65 simultaneously.

The orientation of the support members 42 remains the same as the cam tracks 61 and cam followers 67 push the support members 42 outwards along the linear slide rods 59; only sideways movement along the linear rods 59 occurs. Therefore, the arrangement of the patches of web material being held on the support members 42 is maintained, except that the patches are moved apart from each other to create the spacing in between them.

The patches have been cut along and against the edges of the support members 42 and therefore the cut patches will be same size as the outer surfaces 43 of the support members 42. If a single wrap patch is desired (once around the filter rod) then the arcuate outer surfaces 43 of the support members 42 and the cutting operations may be configured to cut patch with the appropriate length, for example 27 mm. Further, if a double wrap is desired then the support members 42 and cutting operations may cut a double length patch, for example 54 mm long. The same logic applies if other patch lengths are required.

Figure 13A:
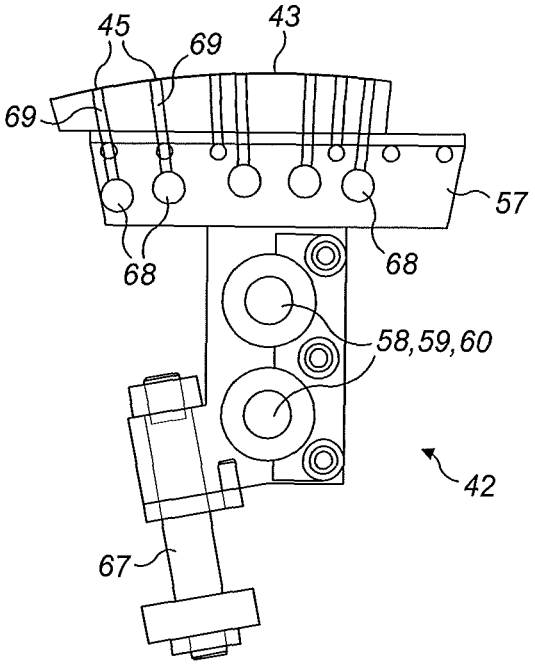
FIGS. 13*a* and 13*b* show different example configurations for the support members of the cutting and spreading drum of FIG. 10.
Figure 13B:
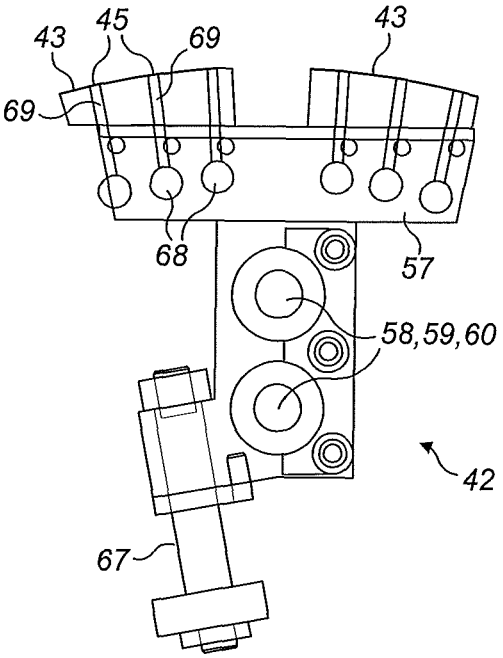

Examples of different support members 42 are shown in FIGS. 13*a* and 13*b*. FIG. 13*a* shows a short length support member 42 for a single wrap patch and FIG. 13*b* shows a longer support member 42 for a double wrap patch. The radial separation of the lateral cutting blades 46 and/or rotational speed of the lateral cutter 20 may also be changed depending on the desired patch length.

FIGS. 13*a* and 13*b* also show an enlarged view of the moveable support members 42, with the body 57 being slideably mounted on the linear slide rods 59 which extend transversely within the rotating outer drum 41. The cam followers 67 are mounted to the body 57 and extend radially inwards towards the stationary cam 56. The outer support faces 43 are provided with a vacuum along the fluid paths 68, 69 which extend transversely through each moveable support member 42 and then up to the apertures 45 on the support surfaces 43 where the web is received. As shown in FIGS. 13*a* and 13*b*, the support surfaces 43 themselves may be detachable from the body 57 of the support members 42 so that the configuration of the support surface can be changed without having to disassemble the rotating drum 41. For example, a single length support surface may be replaced by a double length support surface to change the filter rod configuration being produced in the wrapping apparatus.

Whether the rotating outer drum 41 and support members 42 are arranged for double or single length patches, the number of support members 42 per drum should be sufficient for carrying out each of the cutting operations and the spreading and provide sufficient circumferential space for feeding the web into the drum assembly 10 and transferring the cut patches to the wrapping apparatus. For example, the cutting and spreading drum assembly 10 may be provided with twelve support members 24, as shown in FIG. 10. Alternatively, the cutting and spreading drum assembly 10 may be provided with any number of support members 42, each additional support member increasing the diameter of the drum and/or changing the axial spacing 32 between the patches. Also, the circumferential spacing between the support members 42, which also affects the rotational speed of the other components of the system, can be changed to alter the size and configuration of the rotating drum assembly 10.

Figure 14C:
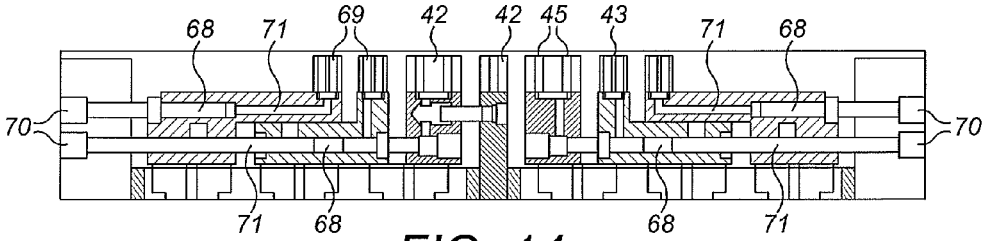
FIG. 14*c* shows a cross-sectional view of the cutting and spreading drum showing a vacuum system.

The vacuum holding force that holds the web and patches on the support members 42 relies on a constant negative pressure being provided to the apertures 45 on the support faces 43 of the support members 42 throughout the web in-feed, cutting and spreading operations. The vacuum force releases the patches during the transfer to the wrapping apparatus. The cross-section of the outer rotating drum 41 shown in FIG. 14*c* shows the vacuum input pipe connections 70 that connect to a negative pressure pipe of a vacuum pump via a rotating manifold, slip-ring or similar connector (not shown) that allows the vacuum to function during rotation of the outer drum 41. As represented by the shaded area in FIG. 14*c*, these connections are in fluid communication with the apertures 45 in the support members 42 through transverse channels 68 and radial channels 69 in the support members 42 and drum 41. Telescopic pipes 71 connect the support members to the manifold in the rotating part of the drum. The telescopic pipes maintain fluid communication between the vacuum input pipe connections and the apertures on the support surfaces during the transverse movement of the support members. As the support members move together and apart from each other the telescopic pipes 71 slide into and out of the transverse channels 68 in the support members 42 to maintain the fluid connection. Ring seals, o-rings or linear slide seals may be used to seal the vacuum fluid path.

It will be appreciated that the apparatus and method described may be modified in various ways and still fall within the scope of the invention defined in the claims. For example, the system may be modified to produce parallel ribbons of web material or the order of the operations described in the description of FIG. 3 may be altered. Furthermore, the adhesive application stage may occur after or during the cutting and spreading process or may not be required at all if the final wrapped filter rod does not rely on adhesive.

Moreover, the apparatus described may be used for purposes other than that described herein and still fall within the scope of the claims. For example, the moving web processes described may be applied to packaging of different items such as food products or others. The apparatus described herein may be applied to any processing of a moving web of material that requires transverse cutting and/or longitudinal cutting and/or spreading of ribbons or patches of material.

In order to address various issues and advance the art, the entirety of this disclosure shows by way of illustration various embodiments in which the claimed invention(s) may be practiced and provide for superior apparatus and method for processing a moving web of material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for processing a moving web of material, comprising:

a drum assembly comprising:

an outer drum having an axis of rotation, a plurality of support members on which cut patches of the moving web of material are supported as the drum rotates together with said support members about said axis, and a cam disposed within the outer drum, wherein the support members and the cam cooperate with each other as the outer drum rotates relative to the cam to move the support members in an axial direction to alter the spacing between cut web patches on said support members, the apparatus further comprising lateral and longitudinal cutting assemblies arranged to cut entirely through the moving web of material to form a series of separate web patches on the outer drum, the lateral cutting assembly comprising a lateral cutting drum having a cylindrical periphery and at least one radially extending blade, said lateral cutting drum being located adjacent to the outer drum such that as each drum rotates the radially extending blade cuts the moving web of material against, or on, a laterally extending edge of one of the support members of the outer drum to cut entirely through the moving web of material on the outer drum, and the longitudinal cutting assembly comprising a plurality of rotating blades arranged adjacent to each other, each blade acting against an edge of one of the support members of the outer drum to cut entirely through the moving web of material on the outer drum.

2. The apparatus of claim 1, wherein the cam comprises a cylindrical element mounted coaxially within the outer drum and having cam tracks extending circumferentially around the surface of the cam, the support members being mounted to the outer drum for movement in an axial direction and each having a cam follower slideably received in a cam track in the cylindrical element.

3. The apparatus of claim 2, wherein the cam tracks are continuous and define closed and open positions of the support members separated by transition regions during which the support members move gradually from one position to the other as the outer drum rotates.

4. The apparatus of claim 3, wherein the transition regions of adjacent cam tracks are staggered so that the support members toward the outer ends of the outer drum begin to move in an axial direction prior to movement of the remaining support members.

5. The apparatus of claim 4, wherein the transition region of adjacent cam tracks are configured such that axial movement of all the support members ends simultaneously.

6. The apparatus of claim 1, wherein each of the plurality of support members comprises an outer face which supports the web, said outer faces having apertures for connection to a source of negative pressure to hold the material on the outer drum.

7. The apparatus of claim 6, comprising flexible or extendable pipes extending laterally within the outer drum between the support members and a manifold that rotates with the drum and is connectable to source of negative pressure.

8. The apparatus of claim 1, wherein the rotational speed of the outer drum and the lateral cutting drum are configured such that the outer surface of the outer drum is travelling faster than the linear speed of the moving web of material, such that as the radially extending blade laterally cuts a portion from the moving web, a space is created between the trailing edge of the cut portion and the leading edge of the moving web of material.

9. The apparatus of claim 1, comprising an adhesive application assembly that applies adhesive to the moving web of material prior to receipt of the moving web of material on the outer drum.

10. The apparatus of claim 9, wherein the adhesive application assembly is configured to apply adhesive to selected regions of one side of the moving web of material, said regions to which adhesive is not applied corresponding to the lines along which the lateral and longitudinal cutting assemblies will cut the moving web.

11. A method of processing a moving web of material comprising:

receiving the moving web of material against an outer drum having an axis of rotation and a plurality of support members, laterally cutting entirely through the moving web of material on the outer drum, wherein the step of laterally cutting comprises rotating a drum that comprises a cylindrical periphery and a radially extending blade that cuts entirely through the moving web of material against, or on, a laterally extending edge of one of the support members of the outer drum, longitudinally cutting entirely through the moving web of material against the outer drum, wherein the step of longitudinally cutting entirely through comprises a rotating blade cutting the moving web of material against, or on, an edge of one of the support members of the outer drum, supporting the separate cut patches of said web of material on the support members as the outer drum rotates about its axis of rotation, the support members cooperating with a cam disposed within the outer drum so that the support members move in an axial direction as the outer drum rotates to alter the spacing between cut web patches on said support members.

12. The method of claim 11, further including controlling the rotational speed of the rotating outer drum and the linear speed of the moving web of material such that cut web portions are longitudinally spaced as the web is laterally cut.

13. The method of claim 11, further including providing a negative pressure to apertures in the plurality of support members to retain the web portions on the rotating outer drum during rotation of said drum.

* * * * *